US006286936B1

(12) United States Patent
Kumon et al.

(10) Patent No.: US 6,286,936 B1
(45) Date of Patent: Sep. 11, 2001

(54) IMAGE FORMING APPARATUS AND IMAGE FORMING METHOD

(75) Inventors: Akira Kumon, Katano; Masahiro Aizawa, Takatsuki; Yoshitaka Kitaoka, Kadoma; Katsutoshi Ogawa, Hirakata; Hiroyuki Matsuo, Neyagawa; Akira Fukano, Ikoma; Akira Ryouji, Osaka, all of (JP)

(73) Assignees: Array Aktiebolag, Vastra Frolunda (SE); Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/274,794

(22) Filed: Mar. 23, 1999

(30) Foreign Application Priority Data

Mar. 24, 1998 (JP) ..... 10-075248

(51) Int. Cl.[7] ..... B41J 2/06
(52) U.S. Cl. ..... 347/55
(58) Field of Search ..... 347/55, 151, 120, 347/141, 154, 103, 123, 111, 159, 127, 128, 131, 125, 158; 399/271, 290, 292, 293, 294, 295

(56) References Cited

U.S. PATENT DOCUMENTS 4,491,855 1/1985 Fujii et al. .
5,984,456 * 11/1999 Bern ..... 347/55

FOREIGN PATENT DOCUMENTS 0 587 366 A1 3/1994 (EP) .
0 788 887 A1 8/1997 (EP) .
44-26333 11/1969 (JP) .
WO 97 35725 A 2/1997 (WO) .

OTHER PUBLICATIONS

European Patent Office Communication dated Aug. 27, 1999 (2 pages).

* cited by examiner

*Primary Examiner*—Raquel Yvette Gordon
(74) *Attorney, Agent, or Firm*—Akin, Gump, Strauss, Hauer & Feld, L.P.

(57) ABSTRACT

An image forming apparatus and an image forming method are characterized in that charged particle jumping can be controlled by applying signals having a small potential difference, and that low-voltage type switching devices can be used as switching devices for the power source. Control electrodes 16 are provided to move charged particles detached from a development roller 2 and to control the movement amount of the charged particles by generating a transfer electric field directly or indirectly between the development roller 2 and a rear electrode 8. A bias electrostatic field is generated between the development roller 2 and the control electrodes 16 by applying a voltage under a jumping start voltage, which is a voltage having the polarity opposite to the polarity of the charged particles and is lower than the jumping start voltage for detaching the charged particles from the development roller 2.

8 Claims, 8 Drawing Sheets

IMAGE FORMING APPARATUS AND IMAGE FORMING METHOD

BACKGROUND OF THE INVENTION

The present invention relates to copiers, facsimiles and printers, more particularly to an image forming apparatus and an image forming method for spraying toner to a recording member for carrying out recording.

Large amounts of documents have recently begun to be treated in offices in accordance with improvement in the performance of personal computers. Furthermore, printers and copiers having high processing capabilities come into wide use in accordance with progress in network technology. In addition, colored documents tend to increase in number in accordance with the abrupt widespread use of ink jet and the like printers. However, apparatuses capable of outputting monochrome documents and colored documents in satisfactory conditions, e.g. at high speed, are now in the course of development, and the advent of such apparatuses is waited for at present.

Prior art will be described below referring to the accompanying drawings. FIG. 8 is a schematic sectional view showing an electric signal recording apparatus disclosed in the Japanese published examined patent application, Publication No. Sho 44-26333.

Referring to FIG. 8, toner 75 is negatively charged for example by friction with fur at the rotation of a brush 76. A power source 77 is connected across a mesh electrode 74 and a back electrode 71 to generate an electric field for accelerating the charged toner 75 toward a recording member 72.

When an electric signal 78 responding to image information is applied across the mesh electrode 74 and a control grid 73 in the above-mentioned electric field generation condition, the amount of the toner 75 passing through the mesh electrode 74 and the adhesion position of the toner 75 to the recording member 72 can be controlled responding to the polarity and intensity of the applied electric signal 78. A parallel electric field for accelerating the toner 75 toward the recording member 72 is generated between the mesh electrode 74 and the back electrode 71 by the power source 77.

When an "on" signal (a positive signal in case the toner 75 is negatively charged) is used as the electric signal 78 and applied to the control grid 73, a gate is opened, and the toner 75 moves toward the recording member 72 along the parallel electric field. On the other hand, when an "off" signal (a negative signal in case the toner 75 is negatively charged) is used as the electric signal 78 and applied to the control grid 73, the gate is closed, and the toner 75 cannot pass through the control grid 73. In this way, images are recorded in accordance with the combination of the "on" and "off" signals used as the electric signal 78.

FIG. 9 is a sectional view showing a schematic configuration of another image recording apparatus disclosed in the Japanese published examined patent application, Publication No. Hei 2-52260. Referring to FIG. 9, a signal electrode 101 and a base electrode 103 are formed around a hole 104 with an insulator 102 disposed therebetween. A recording member 105, e.g. a paper, moves on the surface of a back electrode 106 disposed opposite to the signal electrode 101. The back electrode 106 is connected to a DC power source 109, and a voltage of about 300 V is applied to the back electrode 106. One-component insulating magnetic toner 111 is transferred from a toner transfer member 107 to an image forming position.

An AC power source 108 is connected across the toner transfer member 107 and the base electrode 103. A signal source 110 is connected to the signal electrode 101 and the base electrode 103, and a recording voltage of 50 V is applied to the electrodes 101 and 103. Referring to FIG. 9, the toner transfer member 107 is provided with a stationary magnet 112, and a magnetic blade 114 is provided in the vicinity of the toner transfer member 107.

Next, the image forming operation in the conventional image forming apparatus shown in FIG. 9 will be described below. Thin layers of the one-component insulating magnetic toner 111 are formed on the toner transfer member 107 by the magnetic blade 114. When an AC signal on which an AC or DC signal is superimposed is applied across the base electrode 103 and the toner transfer member 107, the one-component insulating magnetic toner 111 begins a reciprocating or vibrating motion. When a recording signal is input to the signal electrode 101, the one-component insulating magnetic toner 111 passes through the hole 104, and adheres to the recording member 105 in accordance with an electric field applied to the back electrode 106.

As a result, an image is formed on the recording member 105. On the other hand, when no voltage is applied to the signal voltage 101, or when a voltage with the opposite polarity is applied, the one-component insulating magnetic toner 111 does not pass through the hole 104, and no image is formed.

However, the above-mentioned conventional image recording apparatuses have the following problems.

(1) First, a problem is described below, which is encountered in a conventional image forming apparatus disclosed in the Japanese published examined patent application, Publication No. Sho 44-26333 and shown in FIG. 8, wherein the parallel electric field generated between the mesh electrode 74 and the back electrode 71 is controlled by an electric signal applied to the control grid 73. In the case of this kind of conventional image forming apparatus, a sufficient distance is required to be provided between the mesh electrode 74 and the control grid 73 so that the open/close signal generated by the control grid 73 functions sufficiently. However, if a large distance is provided between the mesh electrode 74 and the control grid 73, the toner 75 to be sprinkled is less controllable, whereby proper images cannot be obtained.

Furthermore, in the case of this kind of image forming apparatus, the toner 75 is sprinkled around the apparatus, whereby the basic performance of the apparatus is not satisfactory. Conversely, if the mesh electrode 74 is disposed so as to be close to or make contact with the control grid 73, signals having a large voltage difference must be used as electric signals. This requires the use of a switching device suited for high-voltage switching. For this reason, it is inevitable that this kind of image forming apparatus becomes larger in size and higher in cost.

(2) In such a system disclosed in the Japanese published examined patent application, Publication No. Hei 2-52260 and shown in FIG. 9, wherein the signal electrode 101 and the base electrode 103 are formed on both sides of the insulating member 102, the lines of electric forces for jumping the toner 111 are intensely generated between the signal electrode 101 and the base electrode 103. For this reason, the toner 111 is liable to adhere to an inner wall surface forming the hole 104, and the hole 104 is liable to be clogged with the toner (3) Furthermore, in the system wherein the signal electrode 101 and the base electrode 103 are formed on both sides of the insulating member 102, the lines of electric forces are generated between the two electrodes at all times.

Therefore, the toner 111 is liable to adhere to the inner wall surface of the hole 104. This requires another means for eliminating the toner 111 adhered to the hole 104.

BRIEF SUMMARY OF THE INVENTION

Accordingly, an image forming apparatus in accordance with the present invention comprises at least:

charging means for charging particles to form charged particles;

charged particle transfer means for transferring charged particles and made of a conductive material;

a back electrode for receiving charged particles directly or indirectly;

an aperture electrode disposed between the charged particle transfer means and the back electrode, having a plurality of openings, and also having a plurality of control electrodes being independent from each other and each formed inside the opening or at least at a part of the fringe portion of the opening; and a bias power source for applying a voltage under a jumping start voltage, which is a voltage having the polarity substantially opposite to the polarity of the charged particles and is lower than the jumping start voltage for detaching the charged particles from the charged particle transfer means at the time when the charged particles are not required to be received by the back electrode in accordance with image information.

With the above-mentioned configuration of the image forming apparatus of the present invention, charged particle jumping can be controlled by applying the voltage under the jumping start voltage that is lower than the charged particle jumping start voltage to the control electrodes, that is, by using signals having a small potential difference. As a result, low-voltage type switching devices can be used as switching devices for the power source, and the cost of the apparatus can be reduced.

In addition, the image forming apparatus of the present invention may further comprise deflection electrodes each formed at least at a part of the fringe portion of the opening of the aperture electrode on the side of the back electrode and used to deflect the charged particles in the jumping direction in accordance with image information.

With the above-mentioned configuration of the image forming apparatus of the present invention, the number of switching devices can be reduced significantly by controlling the movement direction of the charged particles by using the deflection electrodes.

Furthermore, the image forming apparatus of the present invention may further comprise a control power source for outputting a control signal to the bias power source to control the charged particles passing through the openings in accordance with image information, whereby the bias power source superimposes a bias voltage on the control signal having been input and applies the jumping start voltage or the voltage under the jumping start voltage to the control electrodes.

With the above-mentioned configuration of the image forming apparatus of the present invention, a large jumping electric field is generated in the opening by the superimposing of the control signal voltage and the bias voltage, whereby the opening is prevented from being clogged with the charged particles.

Moreover, the image forming apparatus of the present invention may further comprise a stopping power source for applying a voltage having the same polarity as that of the charged particles to the control electrodes at the time when the charged particles are not sprinkled from the charged particle transfer means in accordance with image information.

With the above-mentioned configuration of the image forming apparatus of the present invention, a stopping electrostatic field is generated after a printing electric field is generated, whereby the charged particles can be prevented from passing through the opening.

An image forming method in accordance with the present invention comprises:

a step of charging at least particles by using the charging means;

a step of transferring charged particles to an image formation position by using the charged particle transfer means;

a step of applying the voltage under the jumping start voltage, which is a voltage having the polarity substantially opposite to the polarity of the charged particles and is lower than the jumping start voltage for detaching the charged particles from the charged particle transfer means at the time when the charged particles are not required to be received by the back electrode, to the control electrodes each formed at the fringe portion of the opening of the aperture electrode and disposed opposite to the charged particle transfer means at the image forming position; and a step of generating a printing electric field for selectively passing the charged particles from the charged particle transfer means through the opening and for jumping the charged particles to the rear electrode in accordance with image information.

With the above-mentioned configuration of the image forming method of the present invention, the voltage under the jumping start voltage lower than the jumping start voltage for detaching the charged particles from the charged particle electrode is applied beforehand between the charged particle electrode and the control electrode. Therefore, the jumping of the charged particles can be controlled by using the signals having a small potential difference, and low-voltage type switching devices can be used as the switching devices for the power source.

In addition, the image forming method of the present invention further comprises a step of deflecting the jumping direction of the charged particles in accordance with image information by using the deflection electrodes each formed at least at a part of the fringe portion of the opening of the aperture electrode on the side of the back electrode.

With the above-mentioned configuration of the image forming method of the present invention, the number of switching devices can be reduced significantly by controlling the movement direction of the charged particles by using the deflection electrodes.

Furthermore, the image forming method of the present invention further comprises a step of outputting a control signal from the control power source to the bias power source to control the charged particles passing through the openings in accordance with image information, and a step of applying the jumping start voltage on which the bias voltage is superimposed and the voltage under the jumping start voltage to the control electrodes from the bias power source.

With the above-mentioned configuration of the image forming method of the present invention, a large jumping electric field is generated inside the opening by the superimposing of the control signal voltage and the bias voltage, whereby the opening can be prevented from being clogged with the charged particles.

Moreover, the image forming method of the present invention further comprises a step of applying a voltage having the same polarity as that of the charged particles to the control electrodes at the time when the charged particles are not sprinkled from the charged particle transfer means in accordance with image information.

With the above-mentioned configuration of the image forming method of the present invention, a stopping electrostatic field is generated after a printing electric field is generated, whereby the charged particles can be prevented from passing through the opening.

While the novel features of the invention are set forth particularly in the appended claims, the invention, both as to organization and content, will be better understood and appreciated, along with other objects and features thereof, from the following detailed description taken in conjunction with the drawings.

It will be recognized that some or all of the Figures are schematic representations for purposes of illustration and do not necessarily depict the actual relative sizes or locations of the elements shown.

DETAILED DESCRIPTION OF THE INVENTION

Preferred embodiments of the image forming apparatus of the present invention will be described below referring to the accompanying drawings.

Embodiment 1

Figure 1:
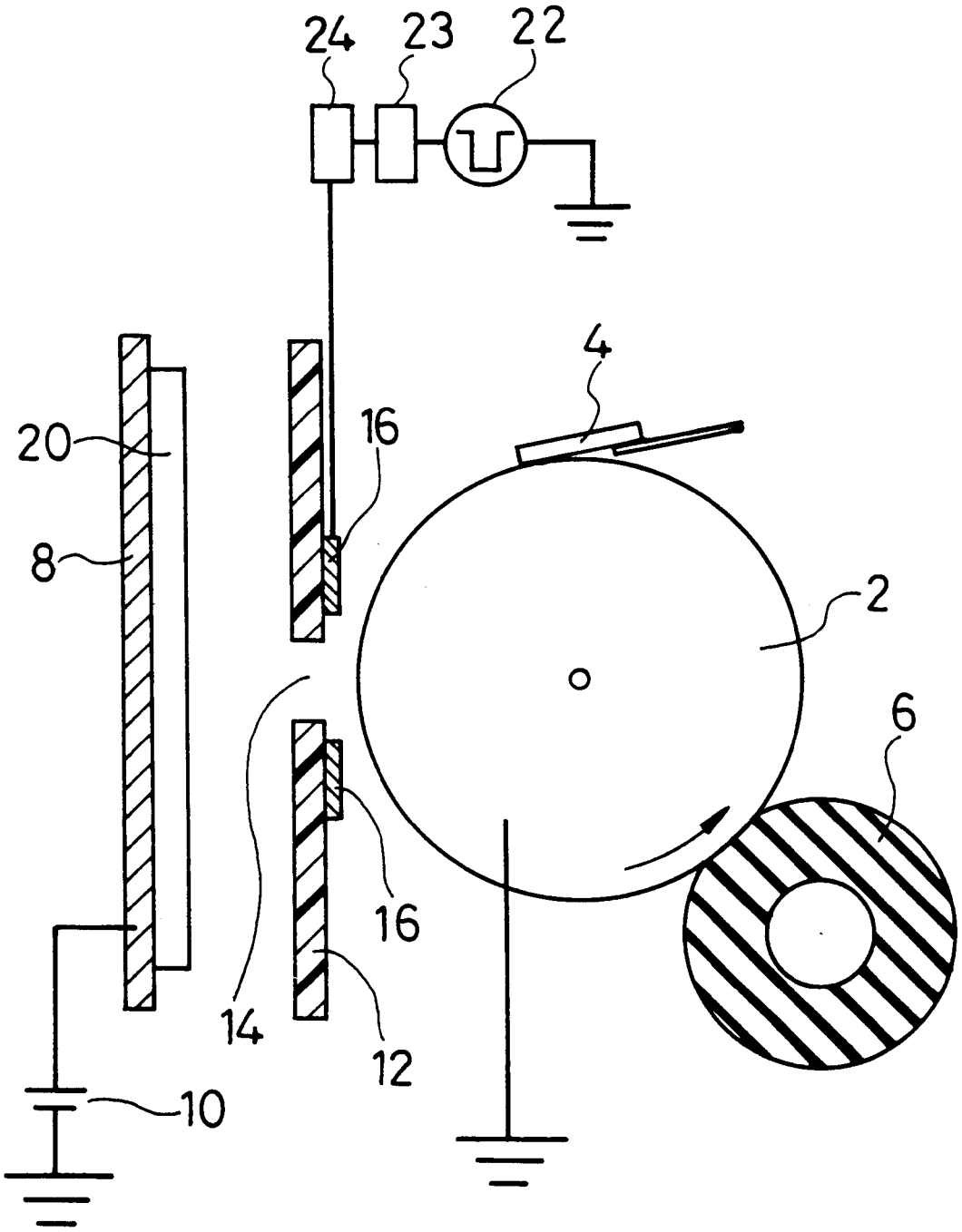
FIG. 1 is a schematic sectional view showing an image forming apparatus in accordance with embodiment 1 of the present invention.

FIG. 1 is a schematic sectional view showing an image forming apparatus of embodiment 1 in accordance with the present invention. Referring to FIG. 1, a development roller 2 used as a charged particle transfer means transfers toner used as charged particles. The development roller 2 in accordance with the embodiment 1 is formed of an aluminum cylinder having an outer diameter of 20 mm and a thickness of 1 mm, and the development roller 2 is grounded. Although the development roller 2 of the embodiment 1 is made of aluminum, it may be made of a metal, such as steel, or an alloy.

Furthermore, the present invention is not limited to the configuration of the embodiment 1. The development roller 2 may be configured so that a DC or AC voltage is applied thereto. A control blade 4 is formed of an elastic material, such as urethane, having a hardness of 40 to 80 degrees (JIS K6301 A Scale).

The length of the free end of the control blade 4 for controlling toner layers on the development roller 2 (the length of a portion extending from the installation member thereof) is in the range of 5 to 15 mm. The proper line pressure of the control blade 4 to the development roller 2 is in the range of 5 to 40 g/cm. One to three toner layers are formed on the development roller 2 by the pressure of the control blade 4. The control blade 4 is used in an electrically floating or grounded condition, or used with a DC or AC voltage applied thereto. In the case of the embodiment 1, the control blade 4 is used in the floating condition. Toner is held between the development roller 2 and the control blade 4, and is subjected to slight agitation therebetween, whereby the toner receives charges from the development roller 2 and is thus charged.

A supply roller 6 making contact with the development roller 2 is formed of a shaft (8 mm in diameter in the embodiment 1) made of a metal, such as steel, which is coated with a layer of synthetic rubber, such as foamed urethane, having a thickness of about 2 to 6 mm. The hardness of the surface of the supply roller 6 is 30 degrees (when the material formed in the shape of a roller is measured in accordance with the method conforming to JIS K6301 A Scale). The biting amount of the supply roller 6 into the development roller 2 should preferably be in the range of 0.1 to 2 mm. The supply roller 6 is used in a grounded condition, or used with a DC or AC voltage applied thereto. The supply roller 6 assists in charging the toner and controls the supply of the toner. The embodiment 1 uses negatively charged toner.

Although a back electrode 8 in the embodiment 1 is formed of a metal plate, it may be formed of a film formed of a conductive filler distributed in a resin. In this case, the resistance of the film should preferably in the range of about $10^2$ to $10^{10}$ Ωcm. At the time of recording a toner image, the toner is directly adhered onto the back electrode 8 to form the toner image, or a recording sheet 20 is placed on the back electrode 8, and the toner is adhered onto the recording sheet 20 to form the toner image.

Furthermore, it may be possible to use a method wherein the back electrode 8 is formed in the shape of an endless film as described above, the toner is directly adhered onto the film, and the toner is transferred onto the recording sheet 20. The distance between the back electrode 8 and an aperture electrode described later should preferably be in the range of 50 to 1000 μm.

In the case of the image forming apparatus shown in FIG. 1, recording is carried out on the recording sheet 20. An aperture electrode 12 is provided with a plurality of openings 14 formed in an insulating film and a plurality of control electrodes 16 correspond to the openings 14, respectively.

The plural openings 14 and the plural control electrodes 16 of the aperture electrode 12 are arranged in a line from top to bottom of the sheet as seen in FIG. 1.

The proper thickness of the insulating film of the aperture electrode 12 is in the range of 10 to 100 μm, and the film should preferably be made of polyimide, polyethylene terephthalate or the like. In FIG. 1, the numeral 22 represents a control power source, the numeral 23 represents a bias power source, and the numeral 24 represents a stopping power source.

Figure 2:
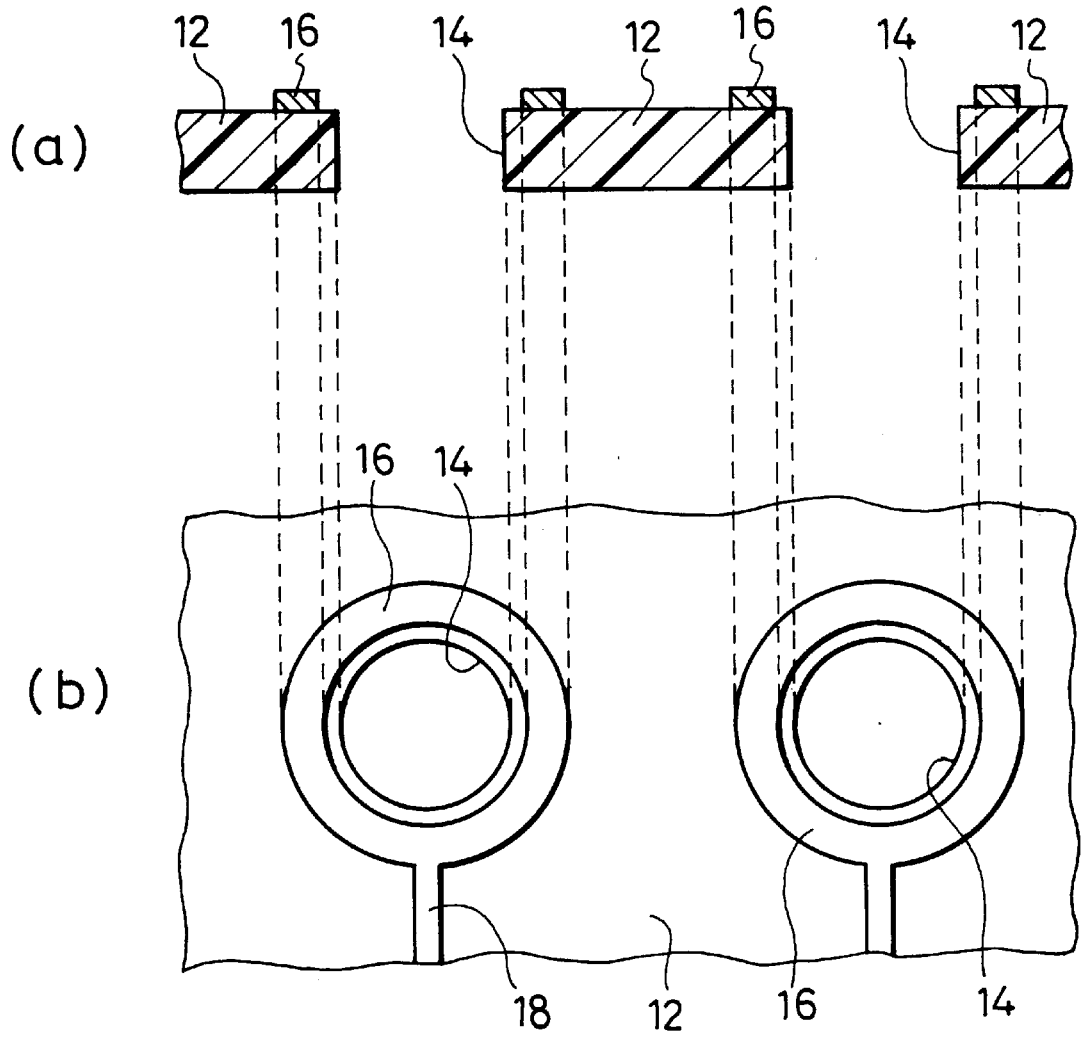
FIG. 2 shows construction views of an aperture electrode in the image forming apparatus in accordance with the embodiment 1 of the present invention, (a) of FIG. 2 is a sectional view of the aperture electrode and (b) of FIG. 2 is a plan view of the aperture electrode.

FIG. 2 is a sectional view showing the structure of the aperture electrode 12 of the embodiment 1, and (b) of FIG. 2 is a plan view showing the aperture electrode 12. The control electrode 16 is formed in the shape of a ring so as to surround the fringe portion of the opening 14 as shown in (a) of FIG. 2. However, the control electrode 16 of the image forming apparatus of the present invention is not limited to the above-mentioned structure, but may be provided on the inner wall surface of the opening 14.

In (b) of FIG. 2, a lead wire 18 extending from the control electrode 16 is connected to the control power source 22 and formed as a pattern trace on the insulating film. A thin resin layer (not shown) having a thickness of 1 to 10 μm is formed on the surface of each control electrode 16. Two openings 14 being separate from each other are shown in (b) of FIG. 2. In actual practice, however, the plural openings 14 are disposed in a staggered arrangement.

In other words, the openings 14 are disposed in the staggered arrangement so as to be supplementary to one another so that, when toner is sprayed from all the openings 14 to carry out recording, a completely black image can be formed. The diameter of the opening 14 should preferably be in the range of 50 to 200 μm. In the case of the embodiment 1, the diameter of the opening 14 is 150 μm, and the inner diameter of the opening 14 is 120 μm. The electrode portion of the control electrode 16 is made of a metal, such as copper, and its thickness should preferably be in the range of 5 to 30 μm. The control electrodes 16 are independently connected to the control power source 22 via the lead wires 18.

The control power source 22 comprises a voltage generation portion (not shown) for generating voltages and switching devices for selecting the voltages by switching. A single switching device has about 32, 64 or 128 channels so that the voltages to be supplied to the control electrodes 16 via the lead wires 18 can be controlled individually. In the case of recording at a recording density of 300 dots per inch (300 dpi), for example, five switching devices, each having 64 channels, are required to control 300 openings.

Figure 3:
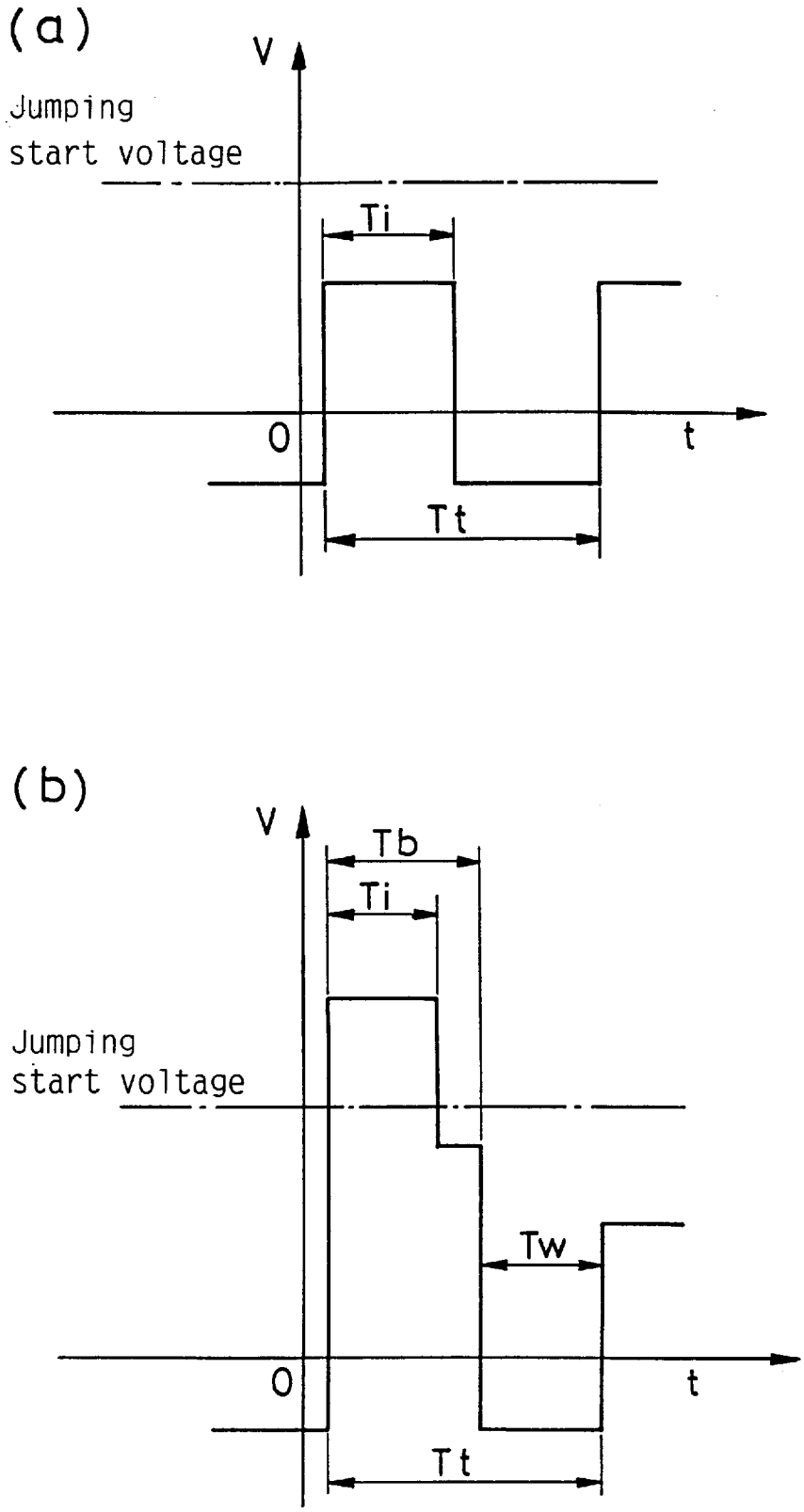
FIG. 3 shows the waveforms of voltages applied to control electrodes in the image forming apparatus in accordance with the embodiment 1 of the present invention, more particularly, (a) of FIG. 3 shows the waveform of a voltage lower than a jumping start voltage, applied in a period Ti, and (b) of FIG. 3 shows the waveform of a voltage applied for recording (toner jumping)

FIG. 3 shows the waveforms of voltages to be applied to the control electrode 16. The ordinate represents voltage, and the abscissa represents time. In FIG. 3, a period Tt represents the time required to form one dot and depends on resolution. In the case of forming dots at a rate of 300 dpi (dots/inch), for example, the diameter of one dot is about 83 μm, which is obtained by dividing 1 inch, i.e. 25.4 mm, by 300 dots. While this one dot is formed, the recording sheet 20 should move by the length amounting to one dot. Accordingly, when the speed of the recording sheet 20 is 60 mm/s, for example, the period Tt is about 1390 μs.

FIG. 3 shows a voltage waveform at the time when a voltage lower than a jumping start voltage is applied to the control electrode 16 in a period Ti. In a constant distance condition (for example, in a condition with respect to the distance between the aperture electrode 12 and the development roller 2), dot formation starts at a constant applied voltage or more. This applied voltage is defined as the jumping start voltage, and a voltage lower than the jumping start voltage is defined as the voltage under the jumping start voltage. For this reason, while the voltage under the jumping start voltage is applied to the control electrode 16, toner is not sprinkled toward the back electrode 8, and nothing is printed.

Figure 4:
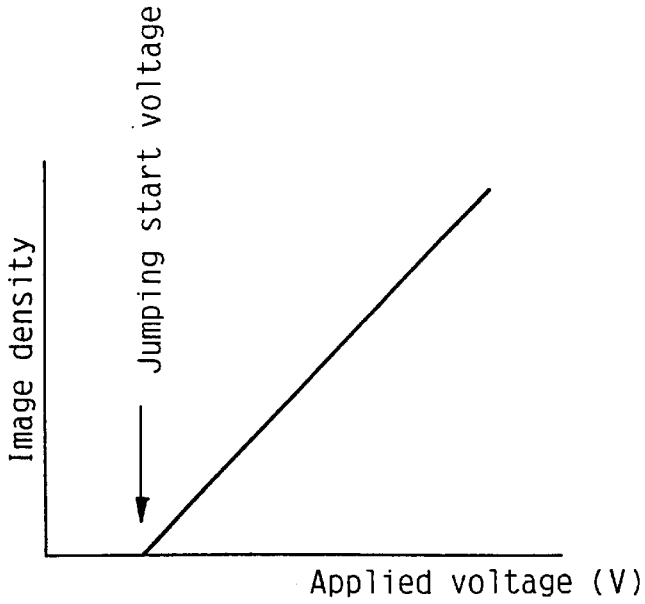
FIG. 4 is a graph showing a toner jumping start voltage in the image forming apparatus in accordance with the embodiment 1 of the present invention, wherein the abscissa represents voltage applied to the control electrodes and the ordinate represents image density.

FIG. 4 shows the jumping start voltage to be applied to the control electrode 16. In FIG. 4, the abscissa represents voltage to be applied to the control electrode 16 and the ordinate represents dot image density. The period Ti shown in (a) of FIG. 3 can be a period arbitrarily determined within the period Tt, i.e., the time required to form one dot. This period Ti should preferably be shorter than a period Tb described later. In the case of the embodiment 1, the voltage under the jumping start voltage is applied from the bias power source 23 to the control electrode 16. This voltage under the jumping start voltage may be applied to all the control electrodes 16 regardless of the presence or absence of signals.

As shown in (a) of FIG. 3, a negative voltage is applied to the control electrode 16 after a lapse of the period Ti, and a stopping electrostatic field is generated to prevent toner from passing through the opening 14.

On the other hand, (b) of FIG. 3 shows the waveform of a voltage applied to the control electrode 16 at the time of recording (at the time of toner jumping). As shown in (b) of FIG. 3, a signal voltage (an image recording signal) exceeding the jumping start voltage is applied in a period Tb. This period Tb is required to be more than the time elapsed while toner is detached from the development roller 2 and reaches the back electrode 8.

More specifically, the period Tb is adjusted to the time during which the dot density is saturated, that is, 200 μs in the case of the embodiment 1. At this time, a bias electric field should be made synchronous with the alternating electric field generated by the signal voltage in view of reducing power consumption. A period Tw following the period Tb represents the time during which an electric field for preventing toner from being detached from the development roller 2 is generated.

A voltage having the same polarity as that of charged toner should be applied from a special power source, such as the stopping power source 24. Since negatively charged toner is used in the case of the embodiment 1, a power source for applying −100 V to the control electrode 16 is used as the stopping power source 24. Since the period Tt is 1390 μs in the case of the above-mentioned example, a voltage of −100 V is applied to the control electrode 16 within a period of about 1190 μs, which is obtained by subtracting Tb=200 μs from the period Tt of 1390 μs.

Figure 5:
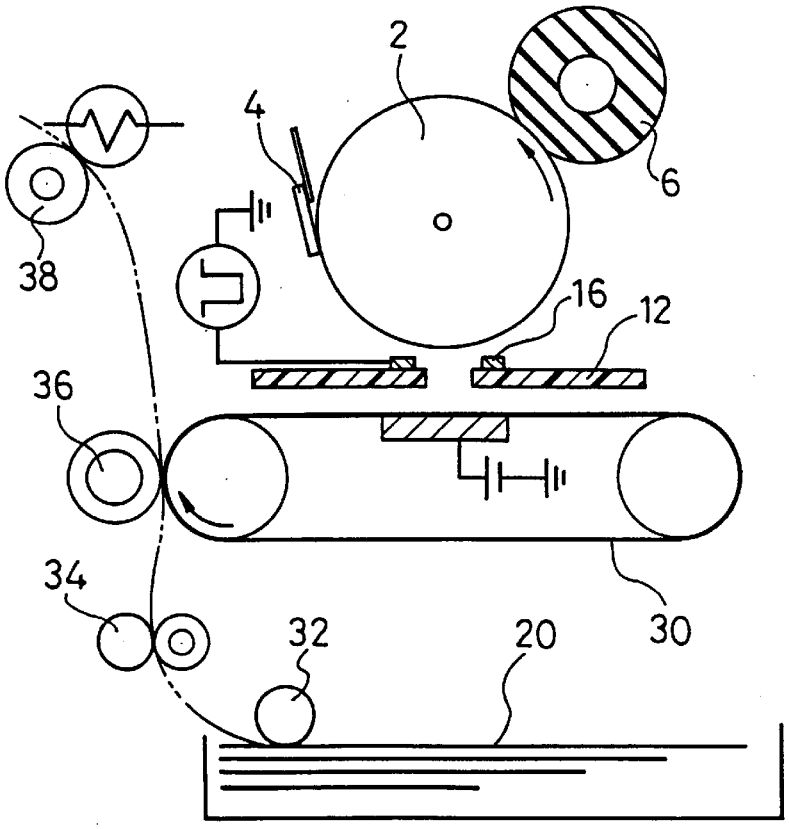
FIG. 5 is an overall view showing the image forming apparatus in accordance with the embodiment 1 of the present invention.

Next, the overall operation of the image forming apparatus of the embodiment 1 will be described below referring to FIG. 5. FIG. 5 is a schematic view showing the image forming apparatus of the embodiment 1. In FIG. 5, an intermediate transfer belt 30 used as an intermediate image holder is formed of a film in which a conductive filler is distributed in a resin, and the resistance of the intermediate transfer belt 30 is $10^{10}$ Ω·cm. The back electrode 8 is disposed so as to make contact with the back side of the intermediate transfer belt 30 at the position opposite to the opening 14.

A pickup roller 32 is provided to feed the recording sheets 20 one by one from a paper feed tray. A timing roller 34 is used to adjust the positional relationship between the recording sheet 20 being fed and the position of an image. A toner image formed on the intermediate transfer belt 30 is transferred from the transfer roller 36 to the recording sheet 20. The transfer roller 36 is formed of a metal roller coated with foamed sponge, such as urethane, and subjected to conductive treatment.

The outer diameter of the transfer roller 36 is 20 mm, and the hardness of the roller is about 30 degrees in JIS K6301 A Scale. Both ends of the metal shaft of the transfer roller 36 are pressed against the intermediate transfer belt 30 at a pressure of about 500 to 1000 g. The electric resistance of the transfer roller 36 was measured when the roller was pressed at the above-mentioned pressure against a grounded metal plate, and 500 V was applied to the metal shaft. The resistance was in the range of about $10^6$ to $10^7$ Ω.

A fixing device 38 fixes toner transferred to the recording sheet 20 by applying pressure and heat. The adhesion of the toner used for the embodiment 1 to the recording sheet 20 is carried out by heating and melting a resin. For this purpose, a styrene-acrylic-based copolymer is used as a resin. In addition to this, a styrene-butadiene-based copolymer, a polyester resin, an epoxy resin and resins made by mixing these can be used as toner. Magnetic toner including magnetic powder may be used as a matter of course. In this case, alloys and compounds, such as ferrite and magnetite, including elements displaying ferromagnetism, such as iron, cobalt and nickel, are effectively used as magnetic powder.

The proper coercivity of the magnetic powder is in the range of 100 to 500 Oe. Furthermore, the proper amount of the magnetic powder to the resin is in the range of 20 to 40% weight with respect to 100% weight of toner particles. In addition, silica ($SiO_2$), titanium oxide ($TiO_2$), metal salt of stearic acid or the like in the range of 0.1 to 5% weight should preferably be added to control the fluidity of a charge control agent and toner. In particular, silica greatly affects the fluidity, and can prevent the opening 14 from being clogged with toner.

Furthermore, since silica is small in diameter and highly chargeable, it is intensely attracted by electric forces and is liable to adhere to the inner wall surface of the opening 14. However, since the toner adhering to the inner wall surface of the opening 14 plays a role of rollers to accelerate the motion of toner passing through the opening 14, whereby hole clogging can be prevented. The BET specific surface area of silica due to nitrogen adsorption should be in the range of 100 to 300 $m^2/g$. If silica having a smaller diameter of less than 100 $m^2/g$, for example, is used, silica is mixed as if it cuts the resin to pieces, whereby toner cannot have sufficient fixing characteristics.

Next, the image forming operation of the image forming apparatus of the embodiment 1 will be described below. In the case of a resolution of 300 dpi, for example, the aperture 12 is provided with 300 openings 14 per inch. These openings 14 are arranged in lines from top to bottom of the sheet as seen in FIG. 5. The plural openings 14 are arranged at positions nearly opposite to the back electrode 8. The control electrodes 16 are formed at the fringe portions of the openings 14 corresponding thereto, and connected to the switching devices via the lead wires 18 (see (b) of FIG. 2).

Each of the control electrodes 16 carries out image formation by combining the applied voltage waveforms shown in (a) and (b) of FIG. 3 and by transferring toner to the intermediate transfer belt 30. In the case of the embodiment 1, the distance between the development roller 2 and the aperture electrode 12 is about 50 μm, and the distance between the aperture electrode 12 and the back electrode 8 is about 150 μm.

A voltage of about 1000 V is applied beforehand to the back electrode 8. A toner image formed on the intermediate transfer belt 30 is transferred to the recording sheet 20 being fed in synchronization with the toner image by applying about 500 V from behind the sheet. The toner image transferred onto the recording sheet 20 is fixed by the fixing device 38 and discharged outside the apparatus.

As described above, in the image forming apparatus of the embodiment 1, a bias voltage lower than the voltage applied for detaching toner from the development roller 2 is applied beforehand between the development roller 2 and the control electrodes 16. With this configuration, toner jumping can be controlled by using signals having a small potential difference. As a result, low-voltage type switching devices can be used as the switching devices for the image forming apparatus of the embodiment 1.

Furthermore, in the embodiment 1, a large jumping electric field is generated in the openings 14 by the superimposing of the bias voltage and the signal voltage to prevent the openings 14 from being clogged with toner, thereby making it possible to attain proper image formation.

Embodiment 2

Figure 6:
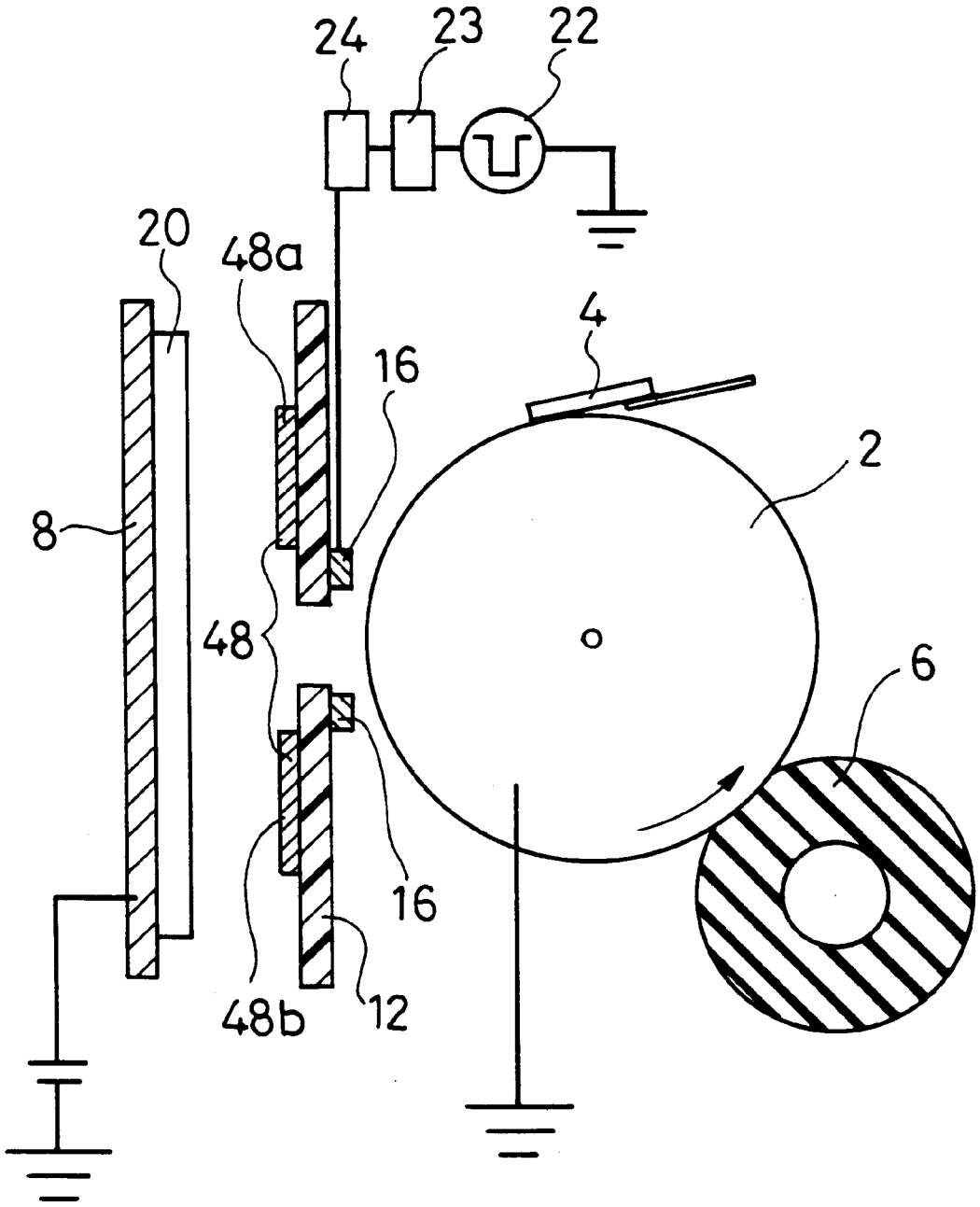
FIG. 6 is a schematic sectional view showing an image forming apparatus in accordance with embodiment 2 of the present invention.

Next, an image forming apparatus in accordance with embodiment 2 of the present invention will be described below referring to the accompanying drawings. FIG. 6 is a schematic sectional view showing the image forming apparatus of the embodiment 2. The components of the embodiment 2 having the same functions and configurations as those of the embodiment 1 are represented by the same reference codes and their explanations are omitted.

The image forming apparatus of the embodiment 2 differs from the image forming apparatus of the embodiment 1 in that deflection electrodes 48 different from the control electrodes 16 are provided on the aperture electrode 12 on the side of the back electrode 8. Electrodes provided at such positions are disclosed in the Japanese published unexamined patent application, Publication No. Hei 4-189554, for example. The electrodes disclosed in the Japanese Publication No. Hei 4-189554 are control electrodes used to take out toner from the development roller.

Each of the deflection electrodes 48 in the image forming apparatus of the embodiment 2 is used to change the transfer direction of toner sprinkled from the development roller 2. This change in direction is adjusted by a voltage applied to the deflection electrode 48.

The voltage under the jumping start voltage, shown in (a) of FIG. 3, is applied to all the control electrodes 16 on the aperture electrode 12 at all times. Furthermore, the voltage shown in (b) of FIG. 3 is applied to the control electrode 16 disposed at positions corresponding to the image portions of image information. In the condition wherein the voltage shown in (b) of FIG. 3 is applied to the control electrode 16, an electric field for carrying out deflection by using the deflection electrode 48 is generated for the toner passed through the opening 14.

As shown in FIG. 6, the deflection electrode 48 is separated into an upper electrode 48*a* disposed at an upper position and a lower electrode 48*b* disposed at a lower position. The upper electrode 48*a* and the lower electrode 48*b* are independently connected to different power sources (not shown) and controlled. For example, when a voltage having an intensively negative polarity is applied to the upper electrode 48*a* of the deflection electrode 48 shown in FIG. 6, and a voltage having a weakly negative polarity is applied to the lower electrode 48*b* of the deflection electrode 48, negatively charged toner electrostatically repels the upper electrode 48*a*, and turns toward the lower electrode 48*b*.

Furthermore, when the intensity of the voltage applied to the upper electrode 48*a* is made lower than that of the voltage applied to the lower electrode 48*b*, toner turns toward the upper electrode 48*a*. By deflecting toner by using the deflection electrode 48 as described above, the transfer direction of the toner can be controlled in three directions, that is, in the upper, lower and straight directions from one opening 14.

Figure 7:
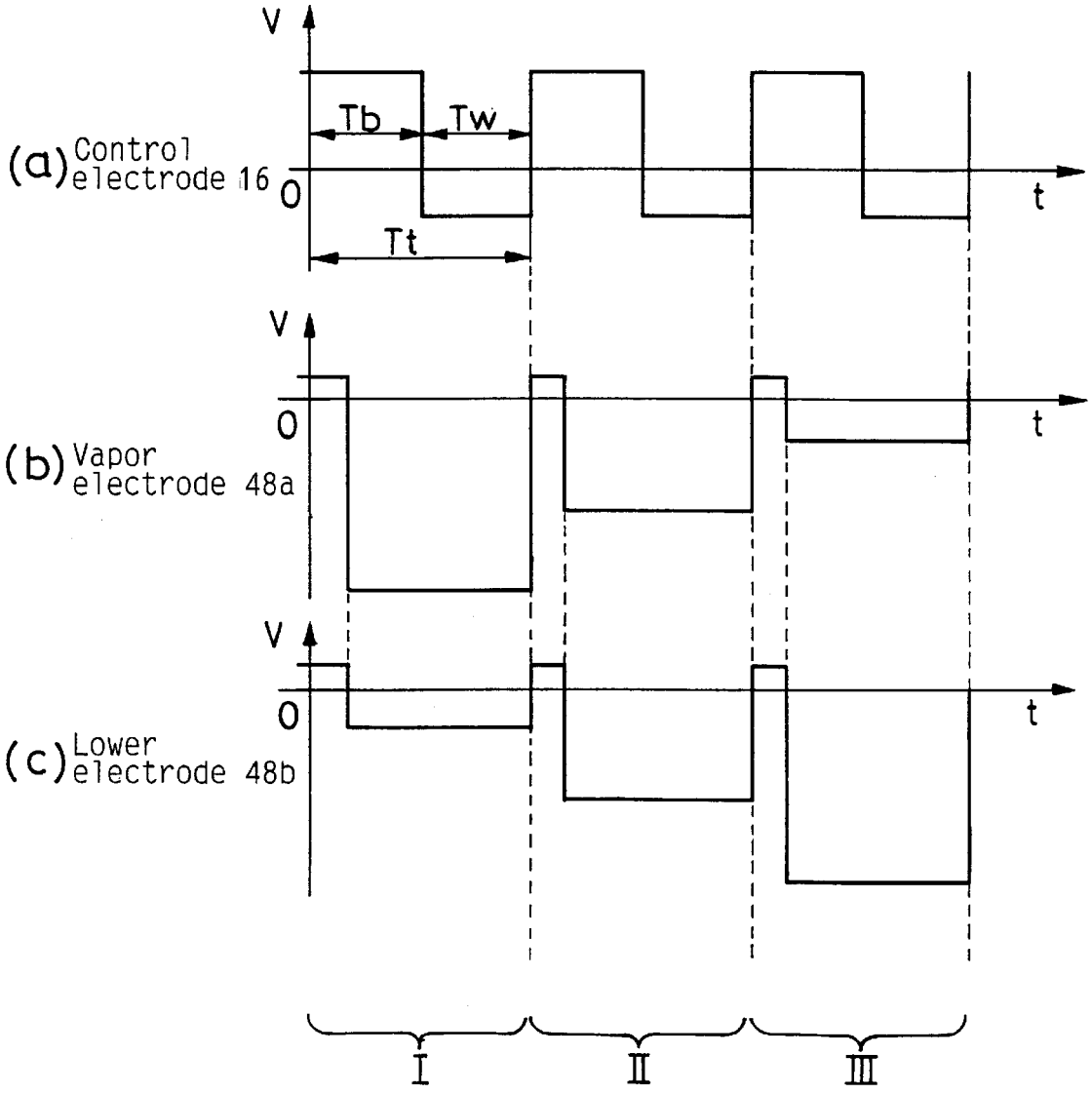
FIG. 7 show the waveforms of voltages applied to control electrodes and the upper and lower electrodes of each deflection electrode in the image forming apparatus in accordance with the embodiment 2 of the present invention.
Figure 8:
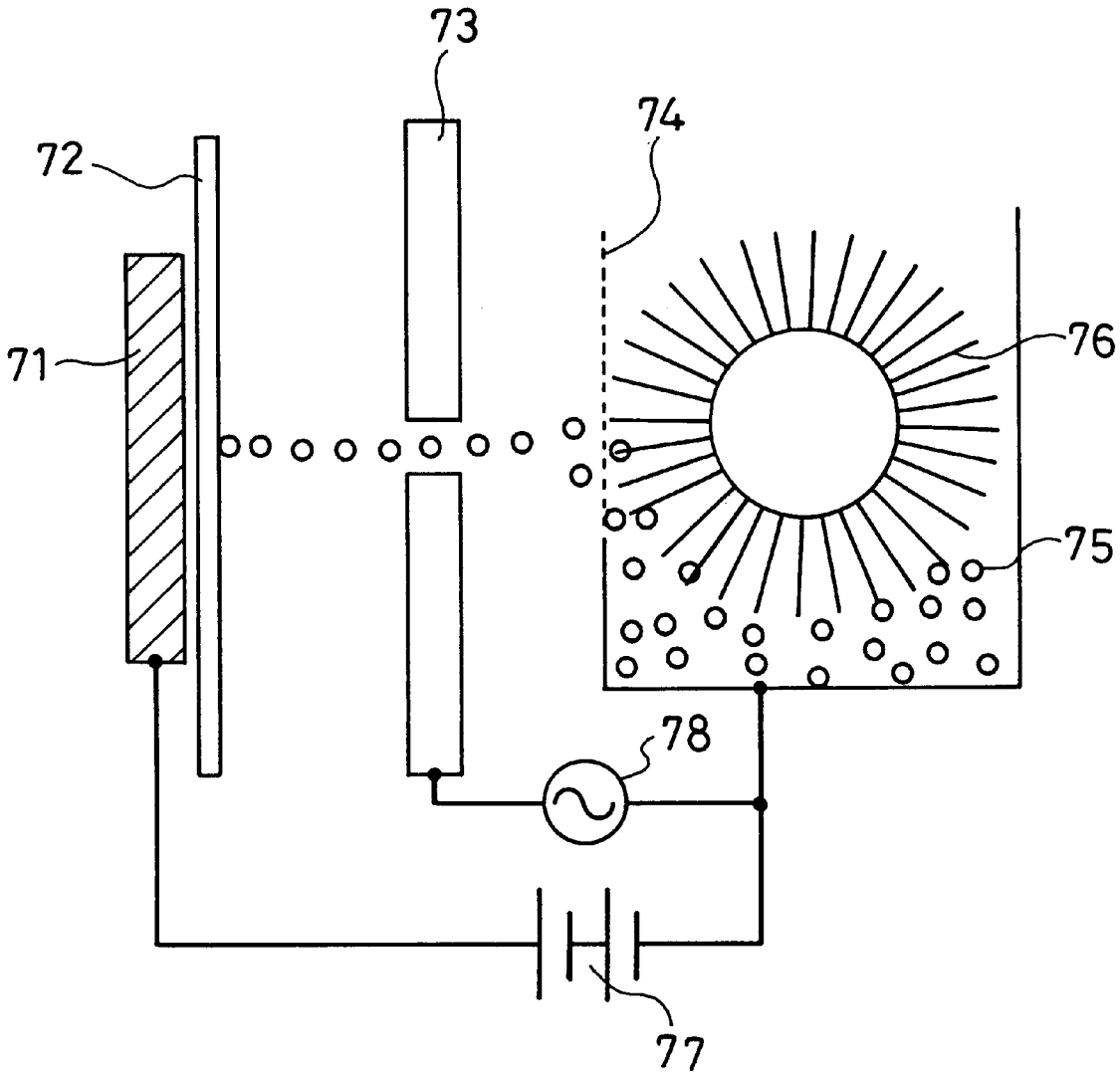
FIG. 8 is a schematic sectional view showing a conventional image forming apparatus.
Figure 9:
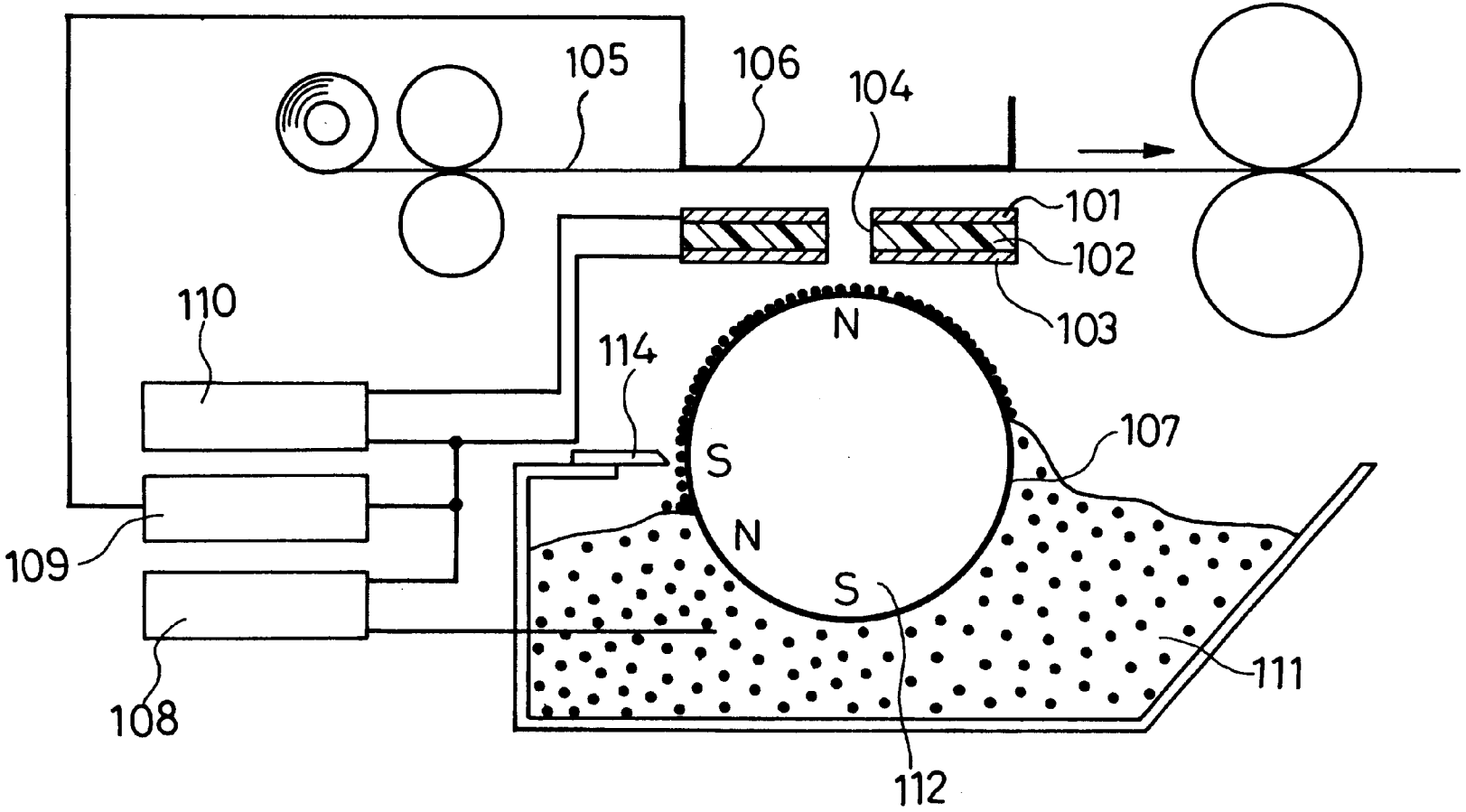
FIG. 9 is a schematic sectional view showing another conventional image forming apparatus.

FIG. 7 shows examples of the waveforms of voltages applied to the control electrode 16, and the upper electrode 48*a* and the lower electrode 48*b* of the deflection electrode 48, respectively. The voltage waveform shown in (a) of FIG. 7 is the waveform of the voltage applied to the control electrode 16, and is the same as the voltage waveform shown in (b) of FIG. 3. The voltage waveform shown in (b) of FIG. 7 is the waveform of the voltage applied to the upper electrode 48*a* of the deflection electrode 48. In addition, the voltage waveform shown in (c) of FIG. 7 is the waveform of the voltage applied to the lower electrode 48*b* of the deflection electrode 48.

In FIG. 7, the abscissa represents time, and the ordinate represents voltage. The voltages applied to the upper electrode 48*a* and the lower electrode 48*b* of the deflection electrode 48 are described below in detail referring to FIG. 7. An intensively negative voltage (about −150 V in the embodiment 2) is applied to the upper electrode 48*a* of the deflection electrode 48 in a first dot forming period (a period represented by (I) in FIG. 7). On the other voltage shown in (b) of FIG. 3 is applied to the control electrode 16 disposed at positions corresponding to the image portions of image information. In the condition wherein the voltage shown in (b) of FIG. 3 is applied to the control electrode 16, an electric field for carrying out deflection by using the deflection electrode 48 is generated for the toner passed through the opening 14.

As shown in FIG. 6, the deflection electrode 48 is separated into an upper electrode 48*a* disposed at an upper position and a lower electrode 48*b* disposed at a lower position. The upper electrode 48*a* and the lower electrode 48*b* are independently connected to different power sources (not shown) and controlled. For example, when a voltage having an intensively negative polarity is applied to the upper electrode 48*a* of the deflection electrode 48 shown in FIG. 6, and a voltage having a weakly negative polarity is applied to the lower electrode 48*b* of the deflection electrode 48, negatively charged toner electrostatically repels the upper electrode 48*a*, and turns toward the lower electrode 48*b*.

Furthermore, when the intensity of the voltage applied to the upper electrode 48*a* is made lower than that of the voltage applied to the lower electrode 48*b*, toner turns toward the upper electrode 48*a*. By deflecting toner by using the deflection electrode 48 as described above, the transfer direction of the toner can be controlled in three directions, that is, in the upper, lower and straight directions from one opening 14.

FIG. 7 shows examples of the waveforms of voltages applied to the control electrode 16, and the upper electrode 48*a* and the lower electrode 48*b* of the deflection electrode 48, respectively. The voltage waveform shown in (a) of FIG. 7 is the waveform of the voltage applied to the control electrode 16, and is the same as the voltage waveform shown in (b) of FIG. 3. The voltage waveform shown in (b) of FIG. 7 is the waveform of the voltage applied to the upper electrode 48*a* of the deflection electrode 48. In addition, the voltage waveform shown in (c) of FIG. 7 is the waveform of the voltage applied to the lower electrode 48*b* of the deflection electrode 48.

In FIG. 7, the abscissa represents time, and the ordinate represents voltage. The voltages applied to the upper electrode 48*a* and the lower electrode 48*b* of the deflection electrode 48 are described below in detail referring to FIG. 7. An intensively negative voltage (about −150 V in the embodiment 2) is applied to the upper electrode 48*a* of the deflection electrode 48 in a first dot forming period (a period represented by (I) in FIG. 7). On the other hand, a weakly negative voltage (about −50 V in the embodiment 2) is applied to the lower electrode 48*b* of the deflection electrode 48. By applying the voltages to the deflection electrode 48 as described above, toner sprayed from the opening 14 turns toward the lower electrode 48*b*.

In the next dot forming period (a period represented by (II) in FIG. 7), the same voltage (about −100 V in the embodiment 2) is applied to the upper electrode 48*a* and the lower electrode 48*b*. As a result, toner sprayed from the opening 14 moves straight without being bent by the deflection electrode 48.

Furthermore, in the next dot forming period (a period represented by (III) in FIG. 7), a weakly negative voltage (about −50 V) is applied to the upper electrode 48*a*, and an intensively negative voltage (about −150 V) is applied to the lower electrode 48*b* so that toner turns in the direction opposite to the deflection direction in the first dot forming period (the period represented by (I) in FIG. 7). If an image forming control signal is not input to the control electrode 16, toner is not transferred toward the back electrode. For this reason, the voltages having the waveforms shown in FIG. 7 should always be applied repeatedly to the deflection electrode 48 in such a manner as described above.

The voltage waveforms in the present invention are not limited to those shown in FIG. 7, but the levels and timing of the voltages applied to the upper electrode 48*a* and the lower electrode 48*b* can be selectively determined depend on the distance and direction of deflection. Since the distance between the development roller 2 and the aperture electrode 12 is in the range of about 30 to 50 μm, for example, it takes about 20 to 40 μs until the time elapsed while toner is detached from the development roller 2 and reaches the opening 14. Therefore, the timing of applying voltages to the deflection electrode 48 may be delayed by 30 to 50 μs from the start of the dot forming period (the period Tt in (b) of FIG. 3).

The image forming apparatus of the embodiment 2 is provided with the deflection electrode 48 on the aperture electrode 12 in the vicinity of the opening 14 and on the side of the back electrode as described above. With this configuration, dot forming and deflection can be controlled as desired, and plural dots can be formed from one opening 14. As a result, a significant cost reduction can be attained, for example, the number of switching devices can be reduced in the image forming apparatus of the embodiment 2.

The image forming apparatus of the present invention configured as described above have the following effects.

The bias voltage lower than the voltage applied when the toner used as charged particles is detached from the development roller 2 used as a charged particle electrode is applied beforehand between the development roller 2 and the control electrode 16. Therefore, the image forming apparatus has a configuration capable of controlling toner jumping by using the signals having a small potential difference. As a result, low-voltage type switching devices can be used as the switching devices for the image forming apparatus of the present invention. In addition, the large jumping electric field is generated inside the opening by the superimposing of the bias voltage and the signal voltage, thereby preventing the opening from being clogged with charged particles. As a result, the present invention can provide an image forming apparatus and an image forming method capable of forming proper images.

Furthermore, the image forming apparatus of the present invention is provided with the deflection electrode 48 formed at least at a part of the fringe portion of the opening 14 on the side of the back electrode and the deflection power sources for applying voltages to the deflection electrode 48. Therefore, the deflection electrode 48 generates a deflection electric field and controls the positions of charged particles to be received by the back electrode 8, whereby it is possible to form high-precision images.

Although the present invention has been described in terms of the presently preferred embodiments, it is to be understood that such disclosure is not to be interpreted as limiting. Various alterations and modifications will no doubt become apparent to those skilled in the art to which the present invention pertains, after having read the above disclosure. Accordingly, it is intended that the appended claims be interpreted as covering all alterations and modifications as fall within the true spirit and scope of the invention.

What is claimed is:

1. An image forming apparatus comprising:

charging means for charging particles to form charged at least particles;

charged particle transfer means for transferring charged particles and made of a conductive material;

a back electrode for receiving charged particles directly or indirectly;

an aperture electrode disposed between said charged particle transfer means and said back electrode, having a plurality of openings, and also having a plurality of control electrodes being independent from each other and each formed inside said opening or at least at a part of the fringe portion of said opening; and a bias power source for applying a voltage under a jumping start voltage, which is a voltage having the polarity substantially opposite to the polarity of said charged particles and is lower than said jumping start voltage for detaching said charged particles from said charged particle transfer means at the time when said charged particles are not required to be received by said back electrode in accordance with image information.

2. An image forming apparatus in accordance with claim 1, further comprising deflection electrodes each formed at least at a part of the fringe portion of said opening of said aperture electrode on the side of said back electrode and used to deflect said charged particles in the jumping direction in accordance with image information.

3. An image forming apparatus in accordance with claim 1, further comprising a control power source for outputting a control signal to said bias power source to control said charged particles passing through said openings in accordance with image information, whereby said bias power source superimposes a bias voltage on said control signal having been input and applies said jumping start voltage or said voltage under said jumping start voltage to said control electrodes.

4. An image forming apparatus in accordance with claim 1, further comprising a stopping power source for applying a voltage having the same polarity as that of said charged particles to said control electrodes at the time when said charged particles are not sprinkled from said charged particle transfer means in accordance with image information.

5. An image forming method comprising:

a step of charging at least particles by using said charging means;

a step of transferring charged particles to an image formation position by using said charged particle transfer means;

a step of applying said voltage under said jumping start voltage, which is a voltage having the polarity substantially opposite to the polarity of said charged particles and is lower than said jumping start voltage for detaching said charged particles from said charged particle transfer means at the time when said charged particles are not required to be received by said back electrode, to said control electrodes each formed at the fringe portion of said opening of said aperture electrode and disposed opposite to said charged particle transfer means at said image forming position; and a step of generating a printing electric field for selectively passing said charged particles from said charged particle transfer means through said opening and for jumping said charged particles to said rear electrode in accordance with image information.

6. An image forming method in accordance with claim 5, further comprising a step of deflecting the jumping direction of said charged particles in accordance with image information by using said deflection electrodes each formed at least at a part of the fringe portion of said opening of said aperture electrode on the side of said back electrode.

7. An image forming method accordance with claim 5, further comprising a step of outputting a control signal from said control power source to said bias power source to control said charged particles passing through said openings in accordance with image information, and a step of applying said Jumping start voltage on which said bias voltage is superimposed and said voltage under said Jumping start voltage to said control electrodes from said bias power source.

8. An image forming method n accordance with claim 5, further comprising a step of applying a voltage having the same polarity as that of said charged particles to said control electrodes at the time when said charged particles are not sprinkled from said charged particle transfer means in accordance with image information.

* * * * *